United States Patent [19]

Gall et al.

[11] 4,203,681

[45] May 20, 1980

[54] SINGLE ELEMENT TYPEWRITER WITH ERROR CORRECTION FEATURE

[75] Inventors: John C. Gall, Chicago; Chester E. Ozimek, Park Ridge; Albert E. Chamberlain, Lake Bluff, all of Ill.

[73] Assignee: Sears, Roebuck and Co., Chicago, Ill.

[21] Appl. No.: 854,534

[22] Filed: Nov. 25, 1977

[51] Int. Cl.[2] ..... B41J 29/26

[52] U.S. Cl. ..... 400/697

[58] Field of Search ..... 400/697, 697.1

[56] References Cited

U.S. PATENT DOCUMENTS

| | | | |
|---|---|---|---|
| 1,905,118 | 4/1933 | Nadell | 400/697 |
| 3,780,846 | 12/1973 | Kolpek et al. | 400/697.1 |
| 3,799,316 | 3/1974 | Davidge et al. | 400/697.1 |
| 3,882,990 | 5/1975 | Genesio | 400/697.1 |
| 3,905,465 | 9/1975 | Frechette et al. | 400/697.1 |
| 3,927,747 | 12/1975 | Wolowitz | 400/697.1 |
| 3,927,749 | 12/1975 | Wolowitz | 400/697.1 |
| 3,987,885 | 10/1976 | Diamond | 400/208 |
| 3,997,047 | 12/1976 | Wolowitz | 400/697.1 |
| 4,108,557 | 8/1978 | Skrzipek | 400/697.1 |

FOREIGN PATENT DOCUMENTS

| | | | |
|---|---|---|---|
| 7610046 | 8/1977 | Netherlands | 400/697.1 |
| 528589 | 11/1940 | United Kingdom | 400/697 |

*Primary Examiner*—Clyde I. Coughenour

*Attorney, Agent, or Firm*—Arnstein, Gluck, Weitzenfeld & Minow

[57] ABSTRACT

A conventional single element IBM correcting SELECTRIC typewriter having an error correction system is modified by adding to the element a universal obliterating type font and providing an error correcting key function which is independent of the other keys.

In the SELECTRIC typewriter the error correcting key is operatively connected with the backspace key so that activation of the error correcting key simultaneously activates the backspace key.

1 Claim, 4 Drawing Figures

SINGLE ELEMENT TYPEWRITER WITH ERROR CORRECTION FEATURE

BACKGROUND OF THE INVENTION

The present invention relates to error correction mechanism for typewriters of the single element type to enable an operator to correct original imprinted errors from the keyboard.

The International Business Machines Corporation (IBM) is a principal commercial supplier of single element typewriters which incorporates special features for making corrections. Such typewriters are sold under the trademark CORRECTING SELECTRIC TYPEWRITER. My invention comprises a modification of the operating mechanism of the error correction system of the IBM SELECTRIC typewriter so that each key function is completely independent from the other thereby permitting the use of a universal print obliterating type font, as will be hereinafter explained. As useful background information for an understanding of the present invention reference is made to the service manual for the IBM CORRECTING SELECTRIC typewriter which illustrates and describes the operating mechanism of this typewriter.

BRIEF DESCRIPTION OF A PREFERRED EMBODIMENT

Figure 1:
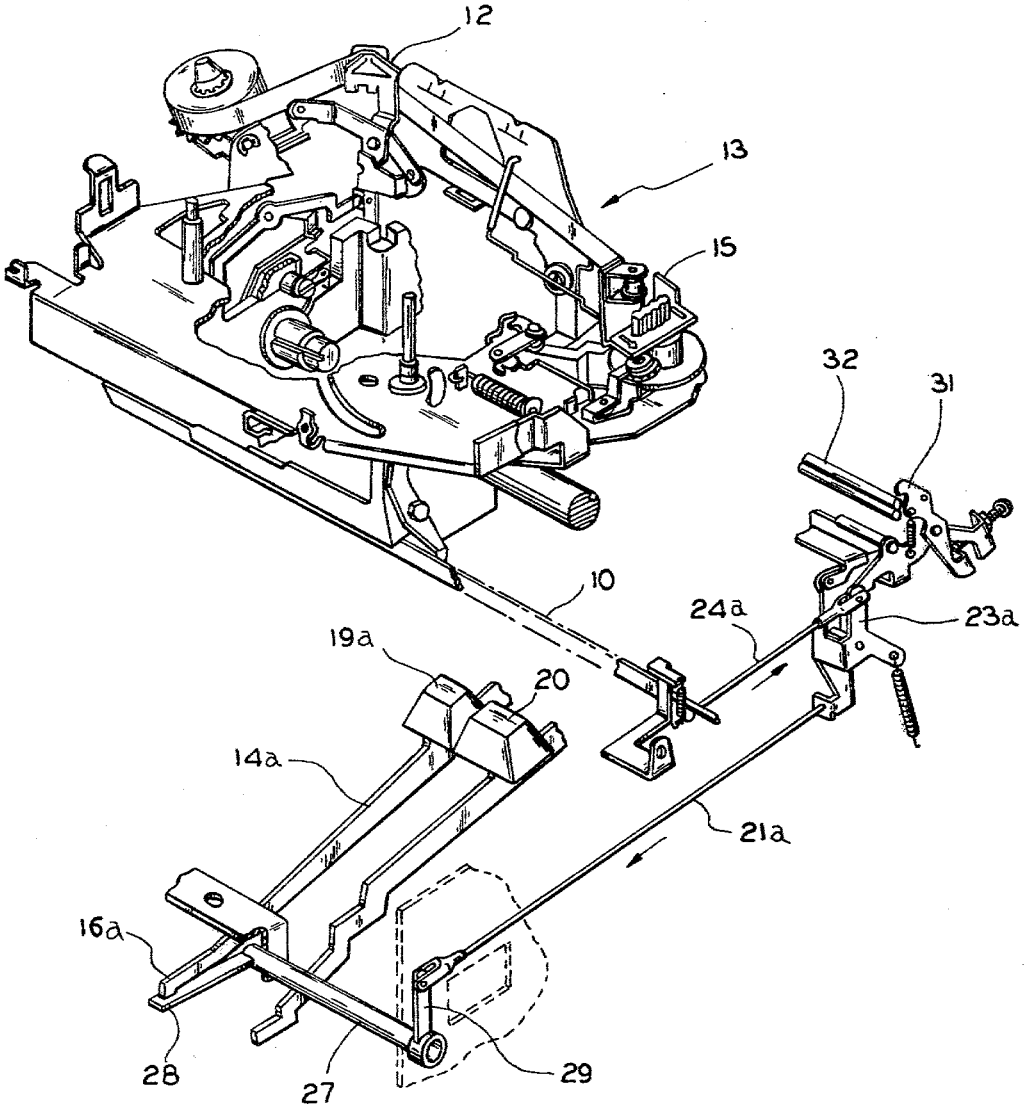
FIG. 1 is a schematic view of the invention in combination with related mechanism of the SELECTRIC typewriter.
Figure 2:
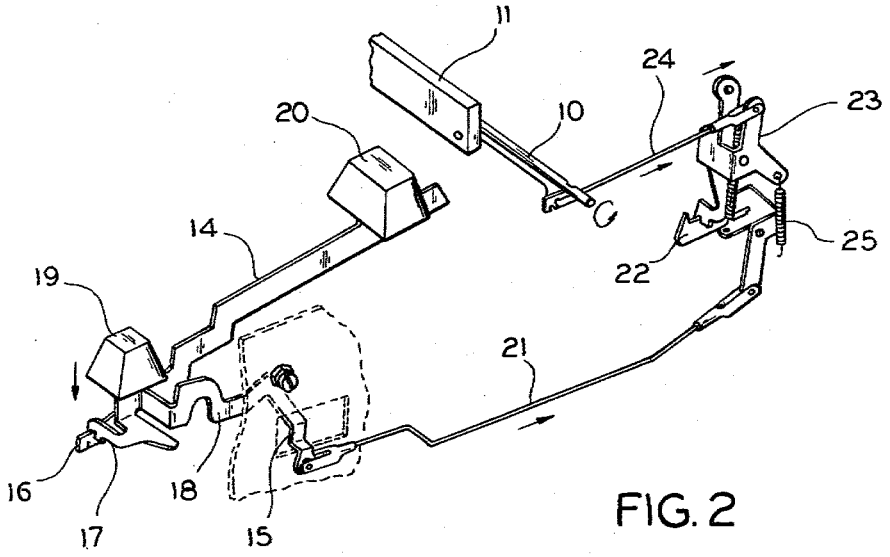
FIG. 2 is a similar view of a portion of the standard SELECTRIC typewriter mechanism prior to modification.

It will be understood that the right hand portion of the correcting mechanism shown in FIG. 1 is the portion to which my invention applies. The left hand portion of the mechanism illustrated is conventional to the SELECTRIC typewriter. FIG. 2 illustrates the standard SELECTRIC typewriter mechanism corresponding to that shown in the right hand portion of FIG. 1 and in the interest of clarity will first be discussed.

The correcting torque bar 10 of the typewriter extends transversely of the machine, immediately to the rear of the front carrier support 11, and is supported for pivotal movement about its longitudinal axis. Its function is to activate the tape lift 12 and the tape feed 15 on the carrier 13 no matter where the carrier may be located along the writing line.

Referring to FIG. 2, the backspace key lever 14 which carries a backspace key 20 and which operates the backspace mechanism, not shown, is provided with a forward extension 16 which is engaged by a lug 17 on the end of the correcting keylever 18. The keylever 18 includes an integral crank arm 15 connected by a link 21 to a mode latch 22 which latches a spring biased mode actuating bell crank 23, which is connected to the torque bar 10 by a torque bar link 24.

When the key 19 is depressed, the lug 17 acts on the backspace keylever 14 to operate the backspace mechanism, not shown. Correspondingly, the correcting keylever 18 is rocked counterclockwise to move the key lever link 21 rearwardly, in the direction of the of the arrow, to rock the mode latch 22 downwardly. This rocking action effects release of the mode actuating bell crank 23 allowing it to pivot clockwise, to the rear, under bias of spring 25. Rocking of the mode actuating bell crank 23 will rock the torque bar 10 in the direction of the arrow to lift its lower portion, thereby activating the tape lift 12 and tape feed 15.

Referring to FIG. 1, which illustrates the present invention, it is seen that a correcting key 19*a* carried on keylever 14*a* is disposed adjacent the backspace key 20, the keylever 14*a* being provided with a forwardly extending keylever portion 16*a*. The key 19*a* designates a location on the type element. This location is to be provided with a universal obliterating type font as described in U.S. Pat. No. 3,729,081. The font when impinged on an obliterating tape effects the deposit over an imprinted character of a layer of opaque material in an area sufficient to cover the largest imprinted character. It is noted that the correcting key 19 and its lever 18 of the SELECTRIC typewriter have been eliminated in the present invention. A correcting function shaft 27 is disposed transverse to the keylever 14*a* and is supported for rocking movement in suitable bearings, not shown. The shaft 27 is provided at one end with a rigid radially directed first arm 28 engaged by the lever portion 16*a*. A second arm 29 is rigidly fixed on the opposite end of the shaft 27 and is connected to the mode actuating bell crank 23*a* by a correcting keylever link 21*a*. It is noted that the mode latch 22 of the SELECTRIC typewriter has been eliminated in the present construction. Except for the structural modifications above described, the typewriter embodying the present invention is identical to that of the SELECTRIC typewriter.

Briefly, the operation of the present invention is as follows:

When the correcting key 19*a* is depressed, the initial downward movement of the lever portion 16*a* acting on arm 28 effects a partial rotation, in a counterclockwise direction, of the function shaft 27 together with forward movement of the keylever link 21*a*, as indicated by the arrow, and rocking of the mode actuating bell crank 23*a*, in a clockwise direction. This movement draws link 24*a* rearwardly lifting the lower portion of the correcting torque bar 10 thereby activating the tape 12 and the tape feed 15. Also, the escapement trigger 31 is conditioned to prevent activation of the escapement and movement of the carrier 13. Continued downward movement of the correction key 19*a* initiates a printing function in a conventional manner. However, in this case the obliterating font which is part of the single element is caused to be activated by the correcting key 19*a*. Following this action of the correcting key the mechanism of the typewriter is restored to its normal operating mode.

Figure 3:
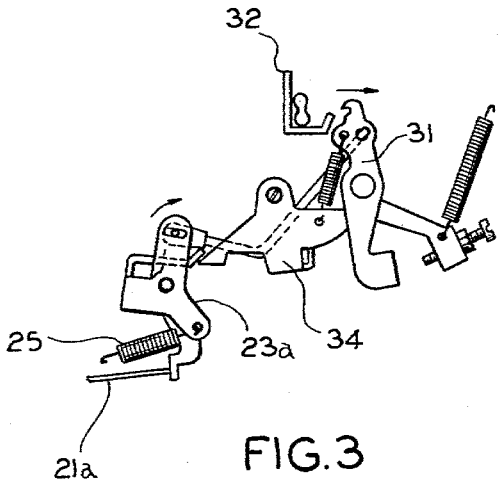
FIGS. 3 and 4 are each end elevational views, on an enlarged scale, of structural details shown in FIG. 1, in different positions of operation.

Referring to FIG. 3, the escapement trigger 31 is shown disengaged from the escapement torque bar 32 so as to prevent movement of the carrier 13 during a correcting cycle. This is accomplished as follows:

As the bell crank 23*a* is rocked clockwise by the link 21*a* to its activated position, the escapement trigger 31 is caused to be moved out of engagement with the torque bar 32. It is held in this disengaged position by the tension of spring 25 on the mode actuating bell crank 23*a* until the trigger lever 34 is operated, either through a print or space bar operation.

Figure 4:
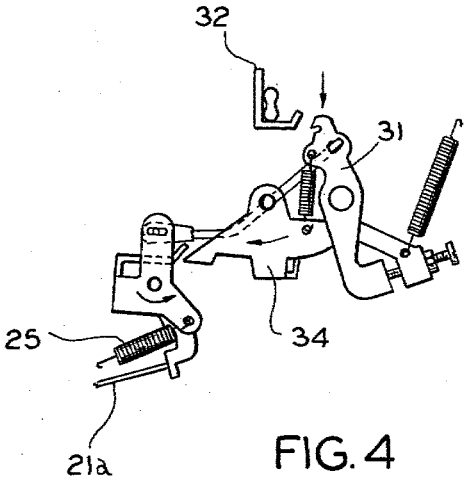

The next time a print or spacebar cycle is initiated, the escapement trigger 31 will not engage the escapement torque bar 32a and no escapement operation will be effected with the result that the carrier 13 will not move. This relationship of the parts is shown in FIG. 4. As the escapement trigger is drawn down during this cycle a forward extension of the trigger lever 34 will engage the mode activating bell crank 23a and rotate it back to its normal position which restores the correcting mechanism to at rest position.

In order to effect correction of an error with the present invention, the operator first actuates the backspace key 20 to align the type element, not shown, of the carrier with the incorrectly imprinted character on the paper. Next the correction key 19a is depressed. This action lifts the correcting tape, activates the obliterating font and prevents movement of the carrier. In the event the incorrect character is not completely obliterated the correction key again may be actuated to complete the obliteration. After obliteration the machine is in a normal operating mode and the correct character key may be struck and normal typing continued.

Various changes coming within the spirit of my invention may suggest themselves to those skilled in the art; hence, I do not wish to be limited to the specific embodiments shown and described or uses mentioned, but intend the same to be merely exemplary, the scope of my invention being limited only by the appended claims.

I claim:

1. In a typewriter of the type having a keyboard, a carrier translatable in a linewise direction across an impression sheet, escapement control means for controlling the movement of said carrier, a single element character imprinting member mounted on said carrier, first means including a ribbon vibrator for feeding a marking tape between said imprinting member and said impression sheet and for raising said first ribbon vibrator during a printing operation, means including a second ribbon vibrator and means for feeding a correcting tape across said impression sheet, a backspace key and keylever operatively connected with said carrier, an escapement torque bar operatively connected to said escapement control means, a mode actuating bell crank, an escapement trigger operatively connected to said bell crank and normally engageable with said escapement torque bar for rendering the escapement effective, the improvement comprising an obliterating type font carried on said single element imprinting member, a correcting key associated with a connecting keylever operatively connected to said imprinting member, means operatively connecting said correcting keylever to said mode actuating bell crank whereby actuation of said correcting keylever will render the escapement control means ineffective to prevent movement of the carrier, lift the correcting tape in imprinting position and actuate the imprinting member to impinge the type font on said correcting tape, said backspace key and keylever being operatively independent of said correcting key and keylever, each successive actuation of said correcting key in each case inhibiting movement of said carrier but returning the control means to normal operational mode following each impingement of said type font on said correcting tape, and said connecting means between said correcting keylever and said mode actuating bell crank comprising a forward extension on said last-mentioned keylever, a shaft rockably supported and extending transversely of said extension, a first rigid arm on said shaft engageable by said extension, a second rigid arm on said shaft longitudinally displaced from said first arm, and link means connecting said second rigid arm to said actuating bell crank.

* * * * *